US005553598A

United States Patent [19]

Johnson et al.

[11] Patent Number: 5,553,598

[45] Date of Patent: Sep. 10, 1996

[54] PNEUMATIC LAUNCHER FOR A TOY PROJECTILE AND THE LIKE

[75] Inventors: Lonnie G. Johnson, Smyrna; John T. Applewhite, Atlanta, both of Ga.

[73] Assignee: Johnson Research and Development Co., Inc., Smyrna, Ga.

[21] Appl. No.: 223,559

[22] Filed: Apr. 6, 1994

[51] Int. Cl.[6] ..... F41B 11/00

[52] U.S. Cl. ..... 124/63; 124/59; 124/69

[58] Field of Search ..... 124/56, 59, 63, 124/64, 65, 69, 71, 73

[56] References Cited

U.S. PATENT DOCUMENTS

| | | | |
|---|---|---|---|
| 1,404,689 | 1/1922 | Fairweather | 124/69 |
| 2,450,029 | 9/1948 | Wells | 124/69 |
| 2,725,868 | 12/1955 | Foster | 124/64 X |
| 2,762,356 | 9/1956 | Foster | 124/65 |
| 3,379,188 | 4/1968 | Walther | 124/69 |
| 3,502,061 | 3/1970 | Yoo | 124/69 |
| 5,373,832 | 12/1994 | D'Andrade | 124/69 |
| 5,373,833 | 12/1994 | D'Andrade | 124/69 |

FOREIGN PATENT DOCUMENTS

| | | | |
|---|---|---|---|
| 462616 | 3/1951 | Italy | 124/63 |

*Primary Examiner*—Eric K. Nicholson
*Assistant Examiner*—John A. Ricci
*Attorney, Agent, or Firm*—Michael Drew

[57] ABSTRACT

A plunger (34) directs pumped fluid through a conduit (40) into a piston sleeve (60) having a piston (66) that is reciprocally translatable within the piston sleeve (60). The conduit (40) terminates in a nozzle (49) which projects into one end, a posterior end, of the piston sleeve (60). The piston sleeve (60) also has a fluid passageway (62) connected with a fluid reservoir (50). A second nozzle (58) at the opposite end, an anterior end, of the piston sleeve (60) leads to a fluid passageway upon which a toy projectile (11) or similar object may be mounted. The piston (66) which is slidable within the piston sleeve (60) has a head (68, 69) at each end formed of compressible material such as soft rubber. A turret (70) enables several mounts (72) for toy projectiles (11) to be consecutively aligned for launching.

20 Claims, 7 Drawing Sheets

PNEUMATIC LAUNCHER FOR A TOY PROJECTILE AND THE LIKE

TECHNICAL FIELD OF THE INVENTION

The present invention relates to launchers for toy projectiles, and more particularly to a launcher that utilizes pressurized fluid to rapidly launch a toy projectile or like object quickly after compressing the fluid.

BACKGROUND OF THE INVENTION

Individuals, particularly children, derive entertainment, and sometimes educational benefits, from propelling a projectile such as a toy foam rocket or arrow toward a desired objective. Toy foam projectiles, such as toy projectiles sold under the Nerf registered trademark, are very useful in this regard because they are lightweight, thus reducing or completely eliminating the possibility of injury from use. Often the toy projectile is projected toward a target, as in the case of a toy foam arrow, or simply hurled upward into the air to travel a desired path, as in the case of a toy foam rocket. The enjoyment and/or benefit derived from a toy projectile is very much dependent upon the means used to launch the projectile. Utilization of the projectile is enhanced by having a forceful, reliable means for launching. A stream of compressed fluid is useful for forcefully imparting momentum to an object, especially a light-weight object such as a toy foam projectile. Generally, a fluid is a reliable means of imparting momentum to an object because a fluid can be used over and over again without the degradation in performance that is likely to be experienced with solid mechanical components over time. Air in particular is a useful fluid for propelling an object because it is easy to contain, plentiful, readily available and harmless to people and the environment. Thus, it can be appreciated that it would be useful to have a reliable means for launching a toy projectile or like object utilizing a fluid to forcefully impart momentum to the projectile.

Another concern in launching toy projectiles and like objects is to have a convenient, reliable means for triggering or releasing the mechanical energy that has been stored in order to impart momentum to the object. Generally, a device for launching an object stores mechanical energy for release at a desired instant. The stored mechanical energy may be in the form of a cocked spring mechanism or fluid, such as air, held in a compressed state. Normally, the means for storing the mechanical energy is distinct from the triggering means. In operating a launching mechanism it is often desirable to be able to quickly, sometimes even immediately, fire the launching device after the mechanical energy has been stored. Achievement of firing quickly after energy storage may be difficult, particularly if the means for storing mechanical energy is very distinct from the means for firing. Thus, it can be appreciated that it would be desirable to have a means for firing a launching device for a toy projectile or like object that enables the device to be fired very quickly after mechanical energy has been stored.

SUMMARY OF THE INVENTION

It is an object of the invention to provide a reliable means for forcefully imparting momentum to a toy projectile or like object.

It is a further object of the invention to provide a reliable means for forcefully imparting momentum to a toy projectile or like object utilizing a fluid.

It is also an object of the invention to provide a reliable means for forcefully imparting momentum to a toy projectile or like object utilizing a fluid which can be fired very quickly after the mechanical energy to be imparted by the device has been stored.

In a preferred embodiment of the present invention, a pump mechanism having a plunger pumps fluid through a conduit into a piston sleeve having a piston that is reciprocally translatable within the piston sleeve. The conduit terminates in a nozzle which projects into one end of the piston sleeve. The piston sleeve has a fluid passageway connected with a fluid reservoir. A second nozzle at the opposite end of the piston sleeve leads to a fluid passageway upon which a toy projectile or similar object is mounted. The piston, which is slidable within the piston sleeve, has a head at each end formed of compressible material such as soft rubber. A turret enables several mounts for toy projectiles to be consecutively aligned for launching. In another preferred embodiment, the mount is pivotable with respect to the pumping mechanism.

Other aspects, objects, features, and advantages of the present invention will become apparent to those skilled in the art upon reading the detailed description of preferred embodiments.

BRIEF DESCRIPTION OF THE DRAWINGS

FIG. 13 is an illustration of the launcher of FIG. 11 in use by an individual, with the projectile mount and reservoir housing of the launcher pivoted into straight-line alignment with the pump portion to utilize the launcher to propel a projectile straight-on.

DETAILED DESCRIPTION OF PREFERRED EMBODIMENTS OF THE INVENTION

Figure 1:
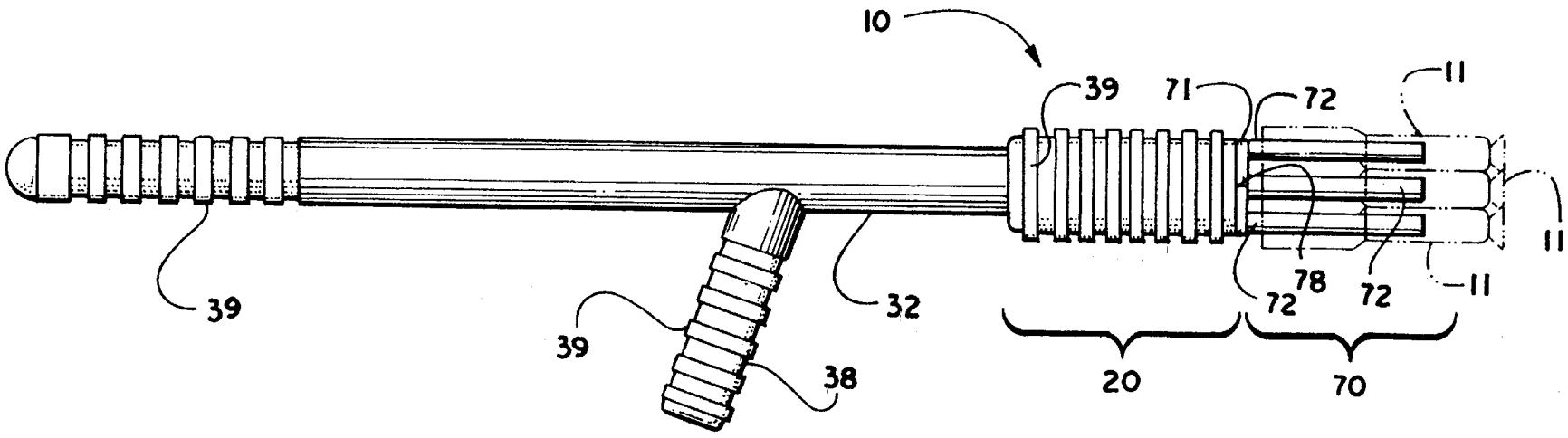
FIG. 1 is a side view of a pneumatic launcher for toy projectiles and like objects according to a preferred embodiment of the invention.

As a general overview, the preferred embodiment of the invention provides a fluid (air) reservoir which is filled with fluid that is pumped by a plunger type of pump. The main components of the system of the invention include the plunger-driven pumping mechanism, the fluid reservoir and a piston sleeve which houses a piston that is reciprocally translatable within the piston sleeve. The piston sleeve essentially serves as a fluid passageway between the pumping mechanism and the fluid reservoir and as a fluid passageway between the fluid reservoir and a mount for a projectile. The hollow mount accomodates a projectile generally having a bore formed in its tail end. The projectile is impaled upon the hollow mount by means of the tail-end bore and is launched when fluid directed through the hollow mount impells the projectile from the mount. The reciprocally-translatable piston works in conjunction with the particular placement of an opening from the pump plunger sleeve to provide a mechanism which automatically seals off the exit passageway for compressed fluid to leave the reservoir (so that the reservoir may be filled) and then quickly opens that same passageway, between the reservoir and projectile mount, so that the projectile may be launched. The reservoir is filled by inserting the extracted plunger into the plunger sleeve. As the plunger is inserted air is forced through a conduit into the piston sleeve impelling the piston into the end of the piston sleeve opposite the end through which the forced fluid enters. The end of the piston sleeve to which the piston is forced has an opening which is sealed off by the impelled piston. The opening leads to a hollow mount for a projectile. Thus, the fluid entering the piston sleeve can only exit the piston sleeve through the passageway between the piston sleeve and reservoir. Further insertion of the plunger into the plunger sleeve compresses fluid into the reservoir. The opening from the plunger sleeve through which fluid exits the plunger sleeve is positioned so that the plunger piston may pass below the opening when the plunger is fully inserted. When the plunger is fully inserted and the piston passes the opening, air may exit the piston sleeve through the plunger sleeve. When fluid is able to exit the piston sleeve through the plunger sleeve compressed air from the reservoir enters the piston sleeve moving the piston to seal off the passageway (the conduit) from the piston sleeve to the plunger sleeve. Compressed air is then able to pass from the reservoir through the piston sleeve into the passageway to the projectile mount. While the specification concludes with claims particularly pointing out and distinctly claiming the subject matter which is regarded as the present invention, the invention will now be described in detail with reference to the following description of preferred embodiments taken in conjunction with the accompanying drawings. Throughout the drawings, the same reference numerals are used to refer to identical features.

Referring first to FIG. 1, in a preferred embodiment of the invention a launcher 10 for a toy projectile is illustrated. This view of the exterior of the launcher 10 shows a central housing 20 with a plunger handle 32 extending rearwardly and a projectile turret 70 extending forwardly. The contents of the central housing 20 and plunger handle 30 will be described in greater detail below. Also visible in FIG. 1 are a handle extension 38 for the plunger handle and the base 71 and projectile mounts 72 of the projectile turret 70 at the front of the launcher 10. The projectile mounts 72 are tubes upon which projectiles 11 may be impaled. The projectiles 11 are launched when a forceful flow (essentially a burst) of fluid is directed through the bore of the tube-shaped mount 72 and ultimately dis-impales the projectile 11. Toy projectiles 11 are illustrated in phantom form mounted upon the mounts 72. Gripping ribs 39 for enhancing grasping of the central housing 20, plunger handle 30, and handle extension 39 are also illustrated.

Figure 2:
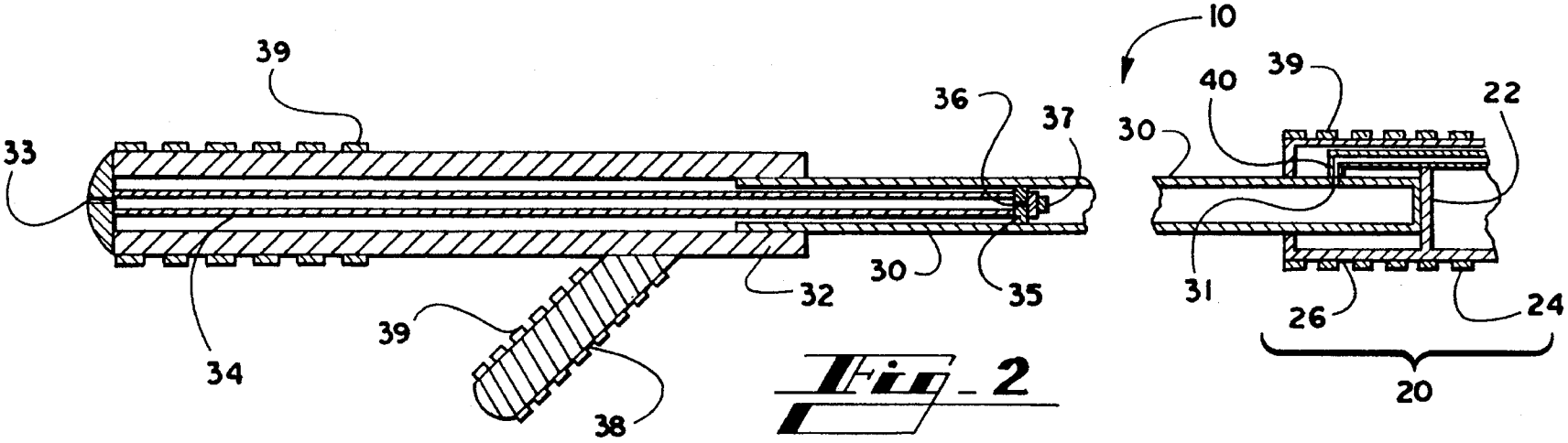
FIG. 2 is a sectional view of the launcher of FIG. 1 with the pump mechanism withdrawn for compressing fluid into the launcher.
Figure 3:
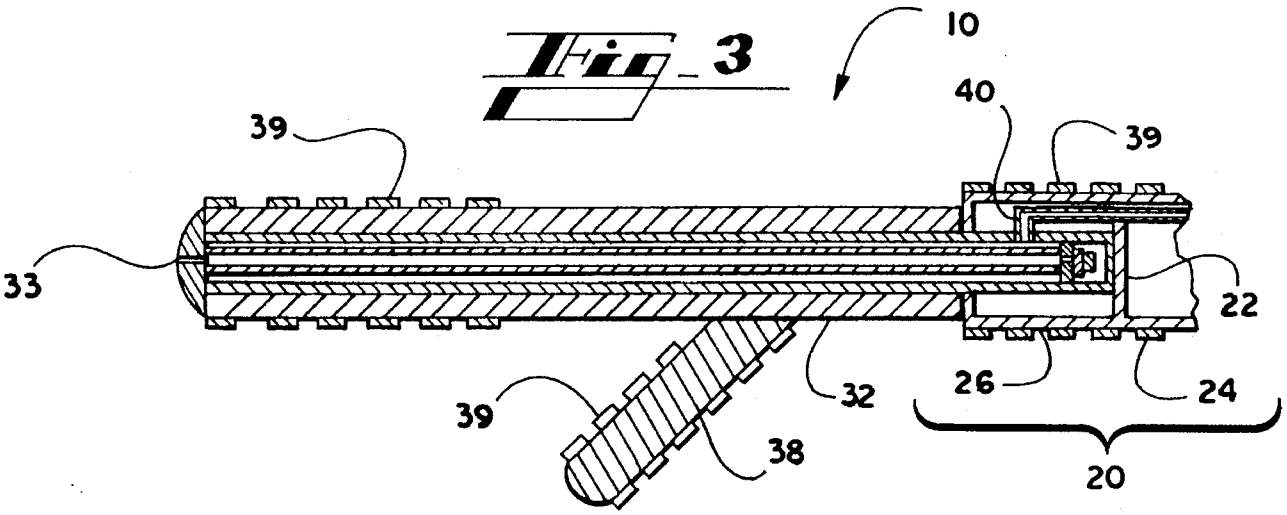
FIG. 3 is the same sectional view as FIG. 2 but with the pump mechanism fully inserted.

FIGS. 2 through 6 are sectional views illustrating the interior components of the launcher 10. Referring now particularly to FIG. 2 and FIG. 3, the interior components of the pumping mechanism for the launcher 10 are detailed. FIG. 2 shows the hollow plunger 34 of the pumping mechanism of the launcher 10 extended and prepared for pumping (or driving) fluid while FIG. 3 shows the plunger of the pumping mechanism fully inserted past the position which has caused the launcher 10 to release compressed fluid and fire a mounted projectile. The components of the central housing will generally be discussed with reference to FIGS. 4, 5 and 6. But first, referring also to FIGS. 2 and 3, the rear portion of the central housing 20 can be seen. The rear portion of the central housing 20 supports the pumping mechanism. In the preferred embodiment, a wall 22 separates the central housing 20 into a reservoir housing 24 and pump support housing 26. The central housing in general and pump support housing 26 in particular supports the plunger sleeve 30 for the plunger-type pump mechanism. The plunger sleeve 30 is slidable within a plunger handle 34. The plunger handle 32 supports the plunger 34 so that the plunger 34 is slidable within the plunger sleeve 30. The plunger 34, plunger sleeve 30, and plunger handle 32 are in coaxial alignment with one another. The plunger 34 is supported at the end of the plunger handle 32. The end of the plunger handle 32 has an aperture 33 through its wall which leads into the bore of the plunger 34. The aperture 33 through the handle 32, an aperture 36 through the plunger piston 35 and a check valve 37 attached to the plunger piston 35 serve as the means through which fluid is drawn into the plunger sleeve 30 for pumping. There are alternate ways in which fluid could be drawn into the plunger sleeve 30. For example, as an alternative, an aperture covered by a check valve could be place at the end of the plunger sleeve 30 with the end of the plunger sleeve 30 exposed to the fluid source. That is to say, in the case of air, the end of the plunger sleeve 30 would be supported in a manner in which it is exposed to the air in general. In the preferred embodiment pumped fluid is able to leave the plunger sleeve 30 through the aperture 31 and pass through the conduit 40 which serves as the fluid passageway connecting the pumping mechanism and the piston sleeve 60 (not shown in FIGS. 2 and 3). The piston sleeve 60 in turn leads to the fluid reservoir chamber 50 which is defined by the reservoir housing 24.

Figure 4:
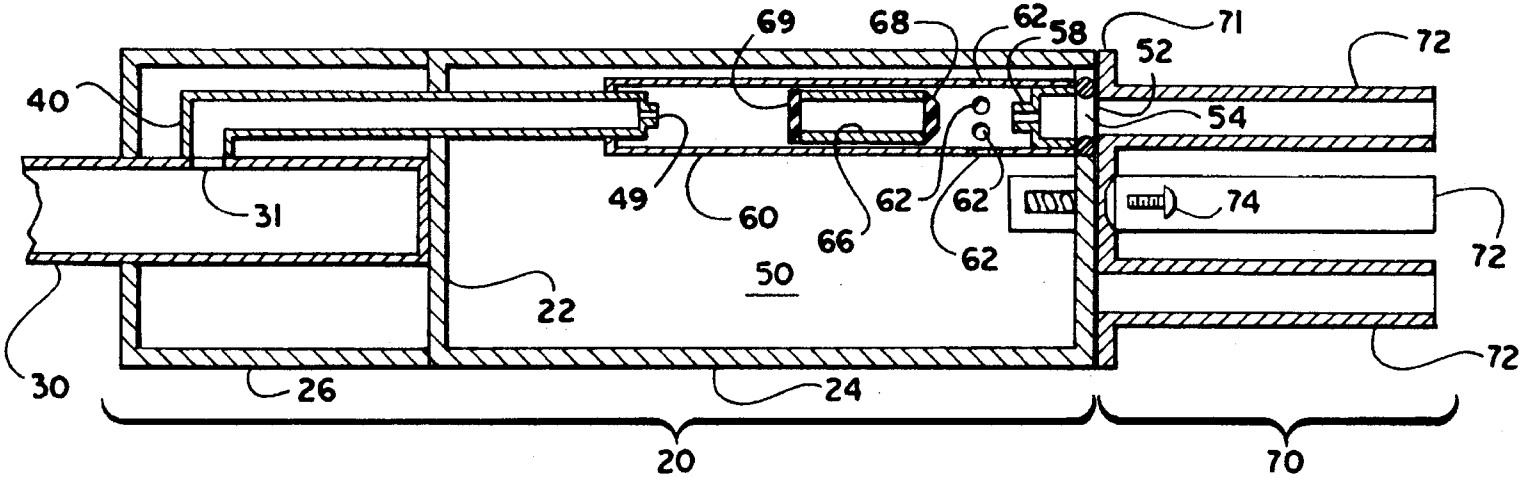
FIG. 4 is a sectional illustration of the central housing of the launcher of FIG. 1 prior to the application of fluid to the device.
Figure 5:
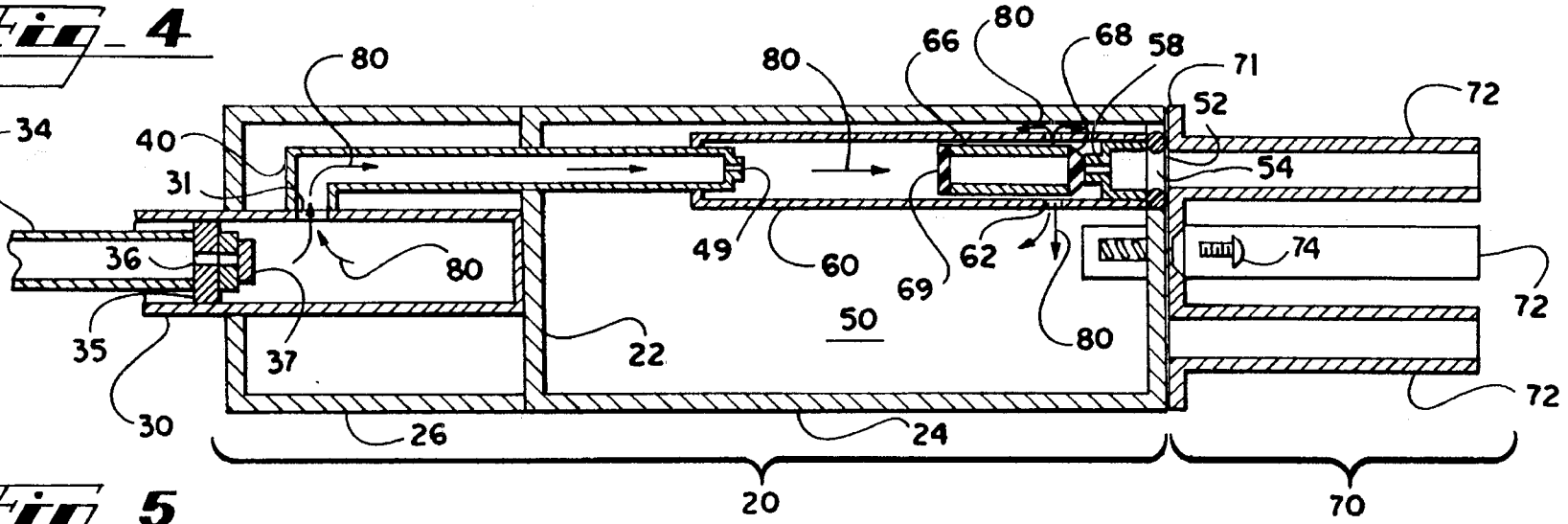
FIG. 5 is the same sectional view as FIG. 4 but also showing the pump plunger as fluid is applied to the device.
Figure 6:
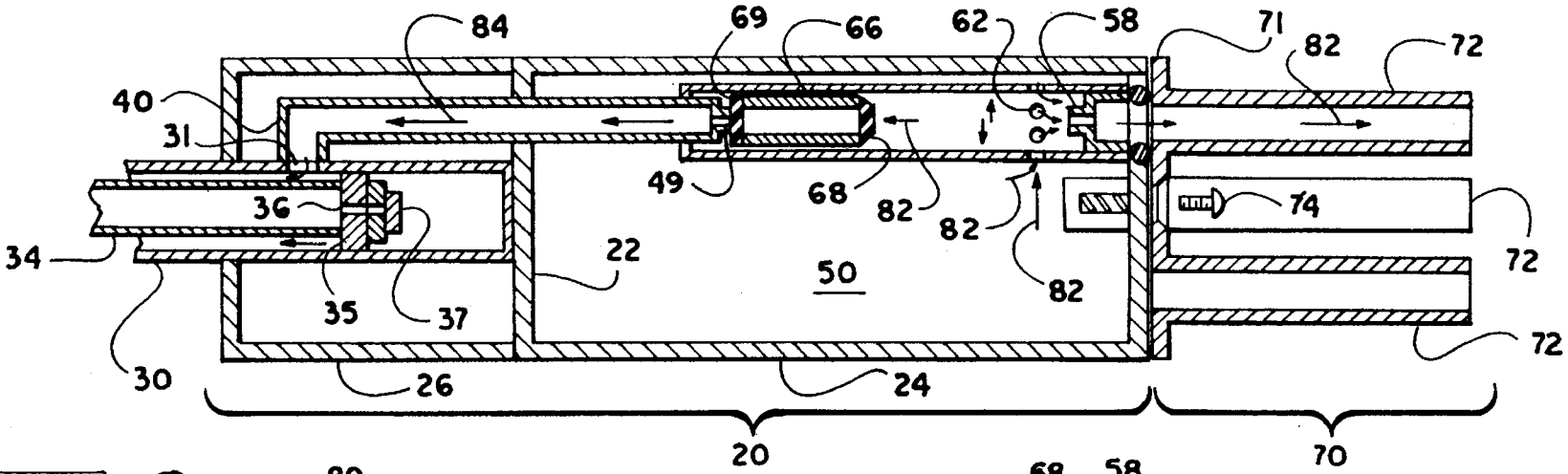
FIG. 6 is the same sectional view as FIG. 4 and FIG. 5 but showing the pump plunger in position for triggering the release of compressed fluid from the device.

Referring now generally to FIGS. 4, 5 and 6, the same sectional view of the central housing 20 of the launcher of FIG. 1 is shown in different stages of use. As previously described, the central housing 20 is generally divided by a wall 22 into a reservoir housing 24 and pump support housing 26. The reservoir housing 24 defines the reservoir chamber 50. One end of the piston sleeve 60 receives an end of the conduit 40 extending to the plunger sleeve 30. A nozzle 49 is formed at the end of the conduit 40 protruding into the piston sleeve 60. The reservoir housing 50 defines an opening 52 that leads to the mount 72 for a projectile. An O-ring 54 serves as a seal between the opening 52 and an end of the piston sleeve 60 which abuts the opening 52. A nozzle 58 covers the end of the piston sleeve 60 abutting the opening 52. Apertures 62 through the side wall of the piston sleeve 60 form a fluid passageway between the reservoir chamber 50 and piston sleeve 60. Thus, in turn, a passageway is formed between the plunger sleeve 30 and reservoir chamber 50 and between the reservoir chamber 50 and opening 52 to projectile mounts 72. A piston 66 is slidable between the ends of the piston sleeve 60. Each end (or head) 68, 69 of the piston 66 is made of compressible material such as soft rubber. The compressible head 68, 69 seals off each respective nozzle 58, 49 when the piston 66 is impelled against a respective end of the piston sleeve 60. A turret 70 allows one of several hollow projectile mounts 72 to be aligned with the opening 52 from the reservoir housing 50. The mounts, or mounting posts, 72 are secured to a turret base 71 which is rotatable with respect to the reservoir housing 24 about a fastener 74.

Figure 7:
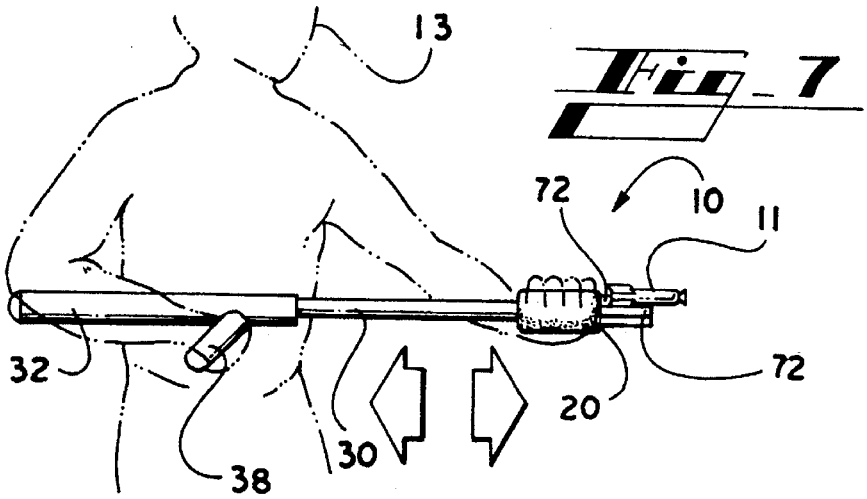
FIG. 7 is an illustration of the launcher of FIG. 1 in use by an individual, with the launcher pump mechanism withdrawn for applying fluid to the device.
Figure 8:
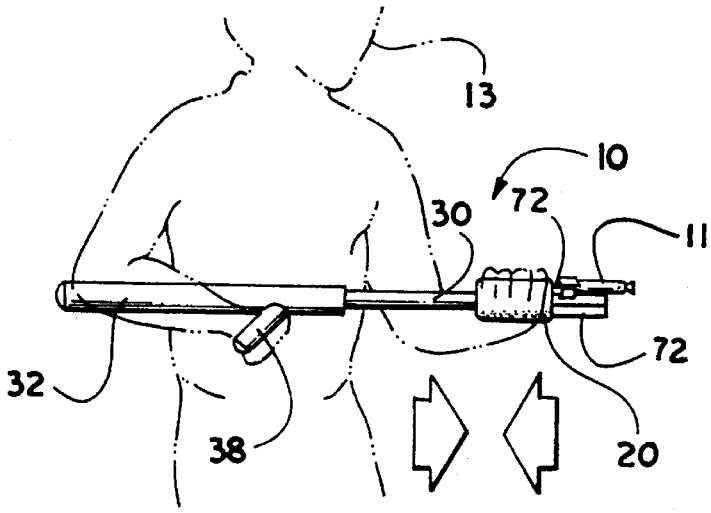
FIG. 8 is an illustration of the launcher of FIG. 1 in use by an individual, with the launcher pump mechanism partially inserted for applying fluid to the device.
Figure 9:
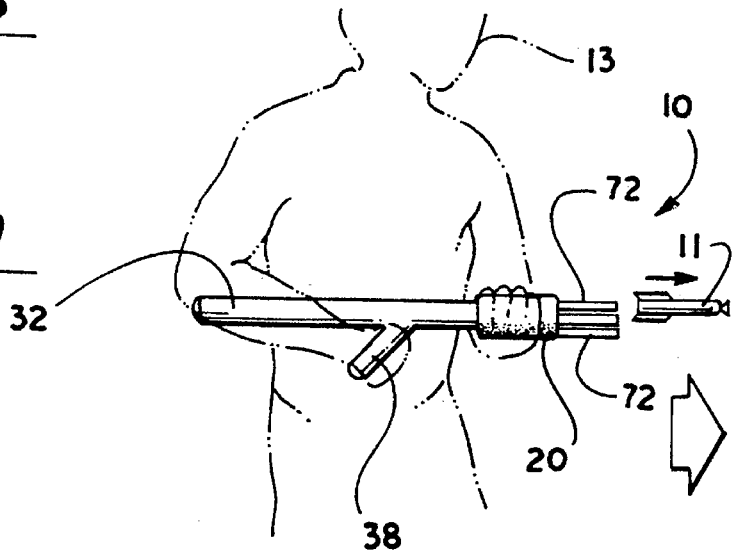
FIG. 9 is an illustration of the launcher of FIG. 1 in use by an individual, with the launcher pump mechanism fully inserted for firing the device.

The operation of the launcher 10 will now be explained with reference to the features and drawings described above and with reference to FIGS. 7, 8 and 9 which illustrate filling of the reservoir 50 with compressed fluid (air) and firing the launcher 10. FIGS. 7, 8 and 9 illustrate use of the launcher 10 by an individual 13 to "load" the reservoir 50 and fire a projectile 11 mounted upon the mounts 72 of the launcher 10. In general, an individual grasps the central housing 20 and plunger handle 32 to operate the launcher 10. Manipulation of the plunger handle 32 is made easier by the handle extension 38 provided. Gripping of the central housing 20, plunger handle 32, and handle extension 38 are enhanced by the ribs 39 which are spaced apart from one another and raised from the surface of the respective components. Referring now momentarily in particular to FIG. 4, therein is illustrated the piston 66 in what may be considered a resting position not abutting either nozzle 49, 58. If the launcher 10 had just been fired the piston 66 would more likely be in a position abutting the nozzle 49 of the conduit 40. Also, when the plunger 34 is withdrawn from the plunger sleeve 30 to begin pumping fluid into the reservoir chamber 50 a low-pressure condition created in the lower end of the plunger sleeve 30 would also cause the piston 66 to be drawn into abutment with the conduit nozzle 49. FIG. 7 illustrates the plunger 34 in the withdrawn position ready for pumping and firing. As previously described, air enters the plunger sleeve 30 following a pathway from the aperture 33 in the handle 32, through the bore of the plunger 34, through the aperture 36 through the plunger piston 35, into the plunger sleeve 30. As the plunger 34 is pushed forward in the plunger sleeve 30 as represented in FIG. 8 and FIG. 5, fluid (air) 80 is forced through the conduit 40, through the conduit nozzle 49 into the piston sleeve 60. Air (fluid) 80 passing through the nozzle 49 is directed against the facing end 69 of the piston 66 impelling the piston toward the opposite end of the piston sleeve 60. The piston head 68 is pressed against the nozzle 58 leading to the reservoir opening 52 sealing the exit passageway. As the plunger 34 is continuously moved inward into the plunger sleeve 30 a continuous flow of fluid (air) is maintained. It is the uninterupted flow of air that creates and maintains the fluid pressure that keeps the piston 66 pressed against the exit passageway nozzle 58. Once the exit passageway is sealed off, air 80 follows the only open path, which is through the apertures 62 of the piston sleeve 60 into the reservoir chamber 50. As the plunger is further inserted fluid continues to enter the chamber 50 under increasing pressure. FIGS. 9 and 6 illustrate full insertion of the plunger 34 into the plunger sleeve 30. The launcher 10 fires by releasing the compressed fluid from the reservoir chamber 50 through the nozzle 58 leading to the opening 52 of the reservoir housing 50. Fluid continues to be forced into the reservoir chamber 50 until the plunger piston 35 passes the opening 31 through the wall of the plunger sleeve 30. When the plunger piston 35 passes the opening 31 through the wall of the plunger sleeve 30 the pressure exerted by the plunger 34 is relieved and the compressed fluid 82 begins to force its way from the reservoir chamber 50 into the piston sleeve 60 and through the available opening presented by the conduit nozzle 49. Because the apertures 62 are closest the front (anterior) end of the piston sleeve 60, the flow of compressed air 82 moves the piston 66 to the rear (posterior) end of the piston sleeve 60 where the rear piston head 69 then abuts the conduit nozzle 49. For convenience and clarity the flow of fluid through the conduit 40 and back into the plunger sleeve 30 is illustrated by the direction arrows bearing numeral 84. The air (fluid) 84 forced back into the plunger sleeve 30 exits the sleeve 30 through the non-sealed slidable interface between the plunger sleeve 30 and plunger handle 32. Once the rear piston head 69 seals off the posteriorly located conduit nozzle 49, compressed 82 fluid flows through the anterior nozzle 58, through the opening 52, and through the bore of the projectile mount 72 upon which the projectile 11 is impaled, thus launching the projectile 11.

Although the launcher 10 of the preferred embodiment shows the piston sleeve 60 encased within the reservoir chamber 50, it is only necessary that there be the passageways described above. That is, a passageway from the plunger sleeve, a passageway between the reservoir and piston sleeve, and a passageway to the projectile mount. For example, the plunger sleeve 30 may be completely separate from the piston sleeve 60 and reservoir housing 24, but rather connected only by the conduit 40. FIGS. 11 through 15 described below illustrate a launcher 12 of such an alternate embodiment. Also, it is not necessary that the piston sleeve 60 lie within the chamber 50. The piston sleeve 60 may lie outside of the reservoir chamber 50 and be connected thereto by a conduit or similar passageway. The mount 72 for a projectile is still positioned at the front (or anterior) end of the piston sleeve 60.

Figure 10:
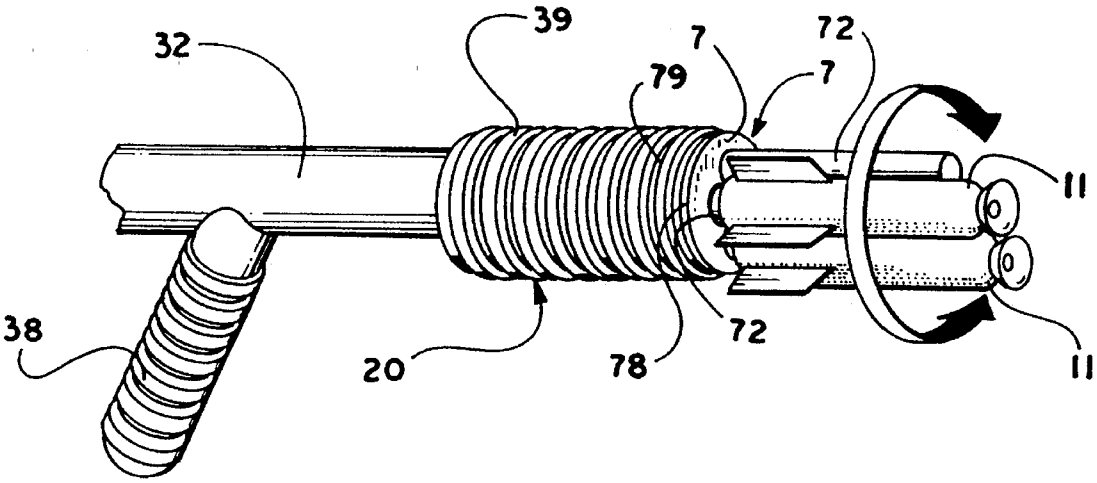
FIG. 10 is an isometric illustration of the launcher of FIG. 1 illustrating movement of the turret to select one of multiple mounts for toy projectiles.
Figure 16:
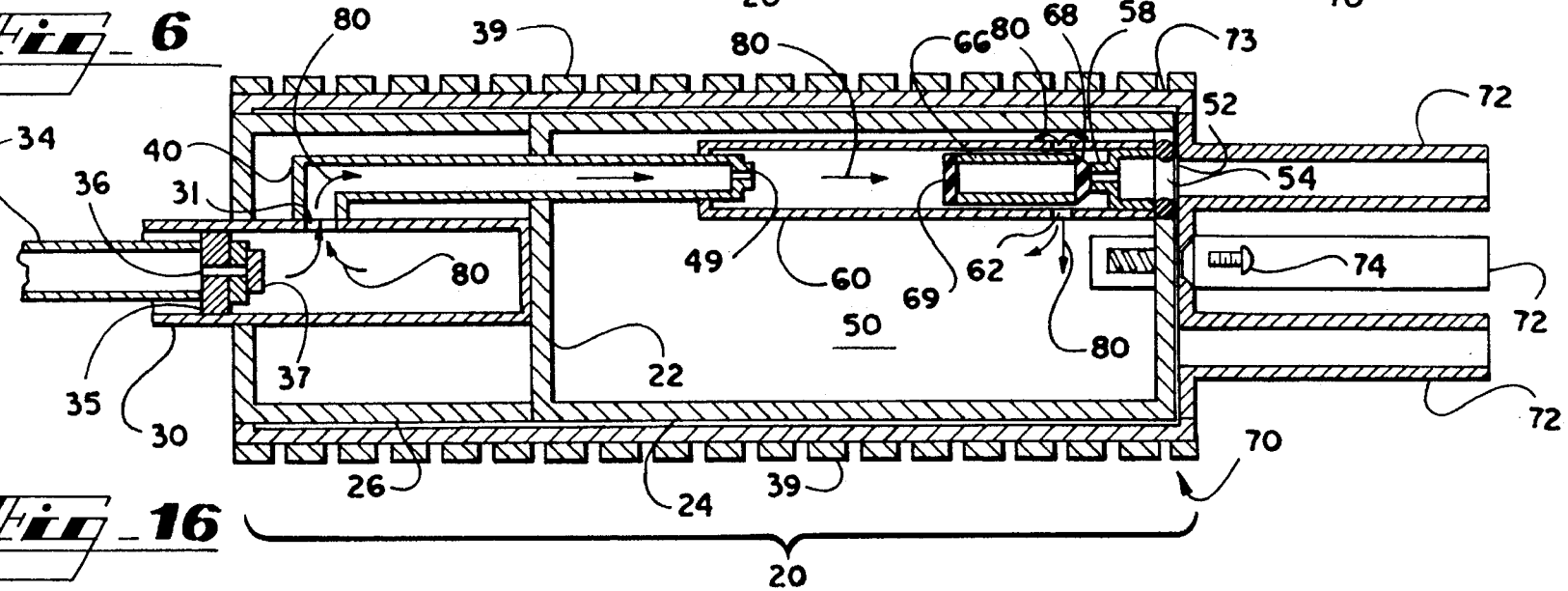
FIG. 16 is an illustration of the launcher of FIG. 1 with an alternative turret base.

Although the launcher 10 launches only a single projectile 11 at a time from a single mount 72, the turret 70 allows several projectiles 11 to be launched in rapid succession, thereby adding to the benefits to be derived from operating the launcher 10. Referring now particularly to FIG. 10, the turret 70 is rotatable with respect to the central housing 20. Once a projectile 11 is launched from a mount 72, the turret base 71 may be rotated with respect to the central housing 20 to align an un-launched projectile 11 for launching. An indexing mark 78 aligned with each projectile mount 71 and an indexing mark 79 on the central housing 20 facilitate proper alignment of the turret mounts 72 for launching. The two indexing marks 78, 79 are aligned with one another to launch a selected projectile. Referring momentarily to FIG. 16, as an alternative to the plate-type of turret base 71 described above a cylindrical turret base 73 which fits over and is rotatable with respect to the central housing 20 may be used. The cylindrical turret base 73 facilitates very easy rotation of the turret 70.

It is also noted that the pumping mechanism and release system may take other forms. It is only necessary that the fluid pressure which directs fluid flow into the piston sleeve 60 be relieved quickly upon filling the reservoir chamber to achieve quick launching when desired.

Figure 11:
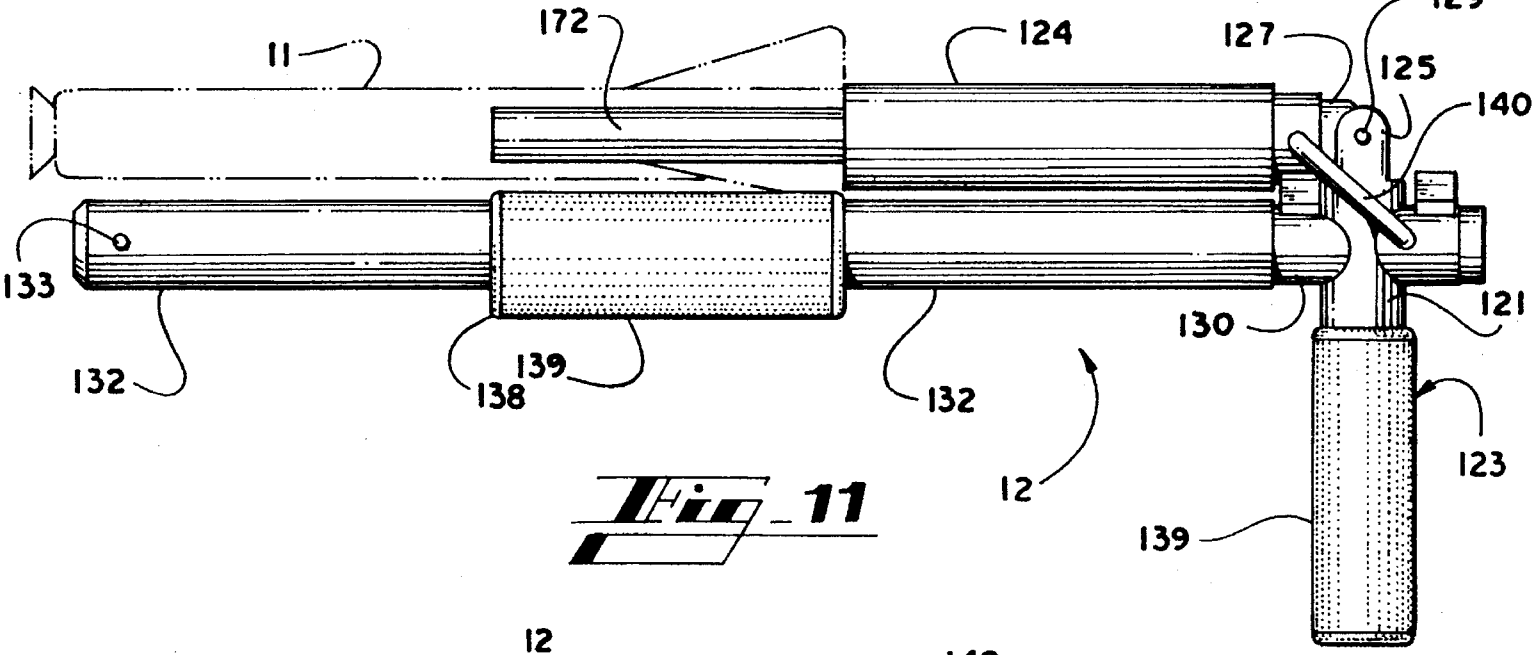
FIG. 11 is a side view of a pneumatic launcher for toy projectiles and like objects according to another preferred embodiment of he invention.
Figure 12:
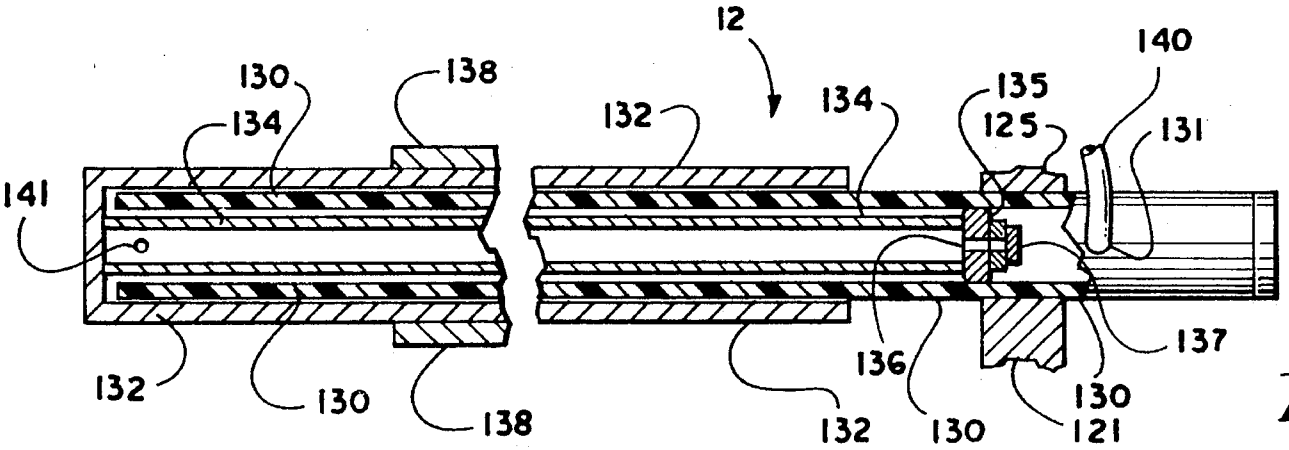
FIG. 12 is a partial sectional view of the pump mechanism portion of the launcher of FIG. 11.

Referring now generally to FIGS. 11 through 15, a launcher 12 according to a second preferred embodiment of the invention will now be described. The launcher 12 illustrated allows the projectile 11 to be launched in various angles of inclination with respect to the pumping mechanism, thus allowing a projectile to be launched in a multitude of directions while the launcher 12 is operated from essentially the same vantage point of an individual 13. The launcher 12 employs a distinct pump mechanism and chamber/piston sleeve as described in the preferred embodiment above. Numbering similar to the numbering of components used to describe the launcher 10 of the first preferred embodiment has been used herein to maintain continuity and clarity. The numbering of similar or identical components is separated by "100." Although the same elements are used the numbering has been altered slightly for clarification to describe the alternate embodiment. Referring particularly to FIG. 11, the plunger sleeve 130 and reservoir chamber 124 are shown folded over with respect to one another. The plunger sleeve 130 is manipulated by means of a plunger handle 132, as discussed above. A handle sleeve 138 enhances manipulation of the handle 132. A primary handle 123 which essentially supports the entire launcher 12 is an added feature of this preferred embodiment. A support member 121 extending from the primary handle 123 supports the plunger sleeve 130. An extension 125 of the plunger support member 121 forms a support member to which the reservoir housing 124 is pivotally attached. A hinge member 127 and pivotal fastener 129 form the pivot joint with the reservoir housing support member 125. As in the launcher 10 of the first preferred embodiment, the plunger sleeve 130 is connected to the piston sleeve and reservoir contained in the reservoir housing 124 by a conduit 140. The relationship between the piston sleeve and reservoir housing of the launcher 12 of the second preferred embodiment is the same as that of the launcher 10 of the first preferred embodiment, as may be seen by momentarily referring to the partial sectional view of FIG. 12. Again, a projectile mount 172 extends from the reservoir housing 124 to support a projectile 11 for launching.

Figure 13:
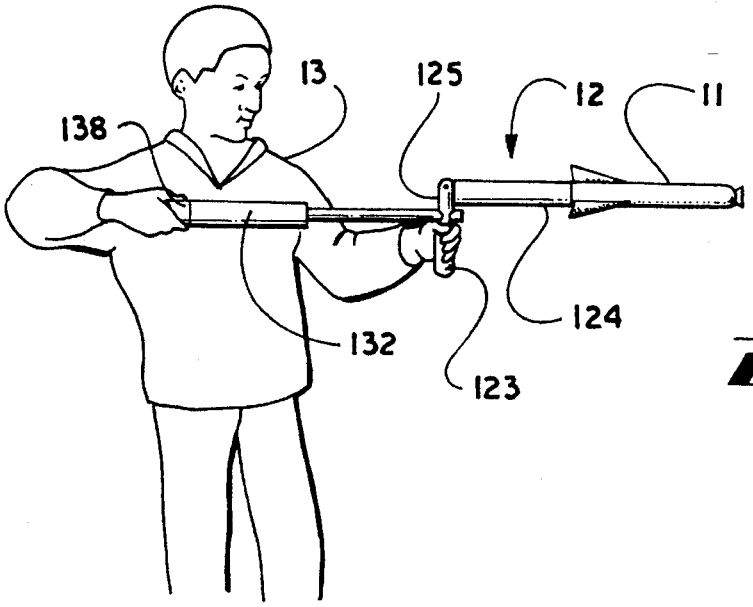
Figure 14:
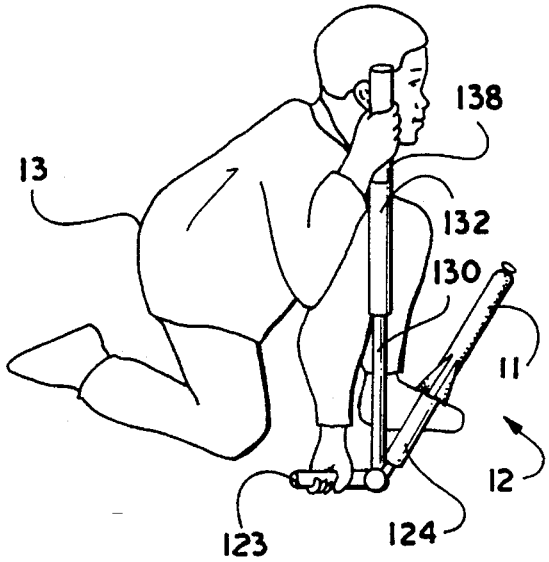
FIG. 14 is an illustration of the launcher of FIG. 11 in use by an individual, with the projectile mount and reservoir housing of the launcher pivoted into angular alignment with respect to the pump portion to utilize the launcher to propel a projectile upward into the air, in the manner of a rocket.
Figure 15:
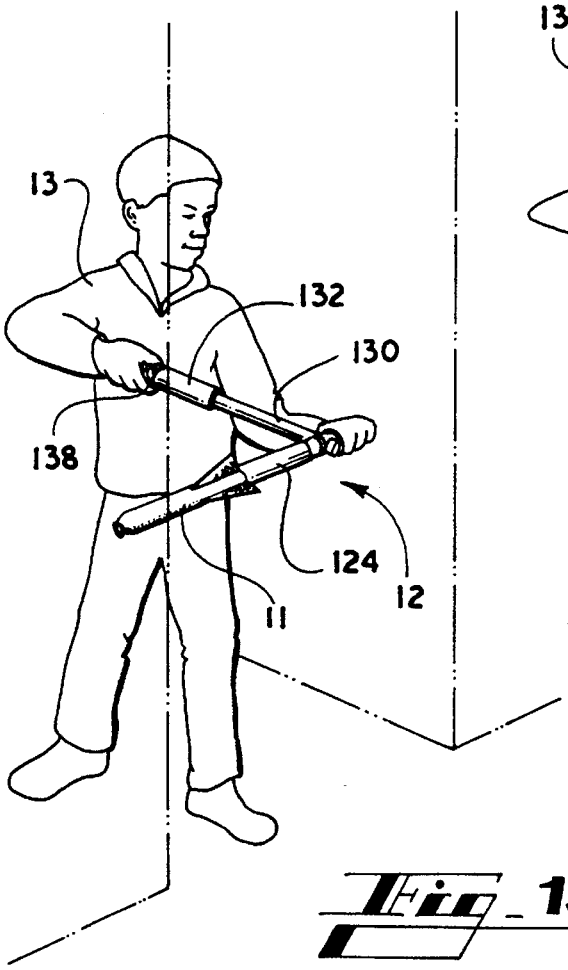
FIG. 15 is an illustration of the launcher of FIG. 11 in use by an individual, with the projectile mount and reservoir housing of the launcher pivoted into angular alignment with respect to the pump portion to utilize the launcher to propel a projectile around an obstruction.

The launcher 12 of the second preferred embodiment is operable in the same manner as described for the launcher 10 of the first preferred embodiment described above except that the mount 172 and launchable rocket 11 of the launcher 12 of the second preferred embodiment may advantageously be pointed in a variety of directions as illustrated in FIGS. 13, 14, and 15. Separation of the plunger portion from the mount 172 portion provides freedom of motion for the pivotable launcher 12. It is noted that it would also be possible to separate all but the mount 172 or the mount plus piston sleeve from the other components of the system and still achieve the range of movement provided by the pivotable launcher 12 of the second preferred embodiment.

As should be apparent from the foregoing specification, the invention is susceptible of being modified with various alterations and modifications which may differ from those which have been described in the preceding specification and description. For example, several alternatives to features of the invention, such as the placement of a fluid intake opening and check valve, have been described above. Another example of a modification which is within the scope of the above description and appended claims is the use of the turret feature with the pivot feature resulting in a launcher with the combined features of the launchers 10, 12 described above. Combining the features is easily achieved by making the plunger sleeve 30 pivotable with respect to the reservoir housing 24. It is also noted that although the invention has been described with particular reference to air as the fluid used to operate the launchers 10, 12 the features of the invention may generally be used to compress and release any compressible fluid to launch a projectile. Accordingly, the following claims are intended to cover all alterations and modifications which do not depart from the spirit and scope of the invention.

What is claimed is:

1. A launcher for a projectile comprising:

a pump for forcefully directing a continuous flow of fluid;

a reservoir for receiving and storing the fluid;

a mount having a bore therethrough for receiving the projectile for launching and for directing the fluid against the projectile so as to disengage and launch the projectile; and a piston structure having a reciprocally translatable piston housed within a piston sleeve which is in fluid-flow communication with said pump, said reservoir and said mount such that said piston is translated to and remains in a first position wherein said piston obstructs a first fluid passageway between said piston sleeve and said mount, permitting fluid flow between said pump and said reservoir, and prohibiting fluid flow between said reservoir and said mount and between said pump and said mount as said reservoir is being pressurized, and when said reservoir becomes substantially pressurized and said pump is not forcefully directing said flow of fluid, said piston translated by said fluid exiting said reservoir to a second position whereby said piston obstructs a second fluid passageway between said pump and said reservoir, permitting fluid flow between said mount and said reservoir and prohibiting fluid flow between said reservoir and said pump and between said pump and said mount.

2. The launcher of claim 1, wherein said fluid is air.

3. A launcher for a projectile comprising:

a pumping mechanism having a plunger terminating in a plunger piston at a first end thereof, having a plunger sleeve closed at one end thereof closely receiving said plunger piston, defining a first aperture through a wall of said plunger sleeve proximate said closed end of said plunger sleeve, and having means for permitting fluid to be drawn into said plunger sleeve and compressed by said plunger piston;

a reservoir chamber for receiving and storing the fluid;

a piston member having an anterior head and a posterior head;

a piston sleeve receiving said piston member in reciprocal translatable relation therein defining an anterior opening facing said anterior head of said piston member and sealable thereby and defining a posterior opening facing said posterior head of said piston member and sealable thereby;

first means forming a passageway for the fluid between said first aperture and said posterior opening of said piston sleeve;

second means forming a passageway for the fluid between said piston sleeve and said reservoir chamber proximate said anterior opening of said piston sleeve; and a mount for receiving the projectile having a first bore therethrough and attached in fluid-flow communication with said anterior opening of said piston cylinder.

4. The launcher of claim 3, said means for permitting fluid to be drawn into said plunger sleeve and compressed by said plunger piston comprising a second bore defined by a shaft of said plunger extending therethrough to said plunger piston, a third bore defined by said plunger piston extending therethrough in alignment with said second bore, and a check valve positioned upon said plunger piston over said third bore.

5. The launcher of claim 3, said anterior head and said posterior head of said piston member comprising compressible material and said anterior opening of said piston sleeve and said posterior opening of said piston sleeve each forming a nozzle.

6. The launcher of claim 3, wherein said reservoir chamber is formed by a reservoir housing, wherein a wall of said piston cylinder is generally encased within said reservoir housing, wherein said second means forming a passageway for the fluid between said piston sleeve and said reservoir chamber comprises at least one second aperture defined through said wall of said piston sleeve, and wherein said first means forming a passageway for the fluid between said first aperture of said plunger sleeve and said posterior opening of said piston sleeve comprises a conduit.

7. The launcher of claim 6, wherein an anterior end of said piston sleeve corresponding to said anterior opening is within said reservoir housing adjacent a wall of said reservoir housing, said reservoir housing defines a third aperture through said wall of said reservoir housing in alignment with said opening at said anterior end of said piston sleeve, and said mounting means for receiving the projectile comprises a plurality of tubes affixed to a base rotatably attached to said reservoir housing such that one of said plurality of tubes may selectively be aligned with said third aperture through said wall of said reservoir housing.

8. The launcher of claim 6, further comprising a support housing for supporting said plunger sleeve and wherein said support housing and said reservoir housing are joined to one another generally forming a central housing.

9. The launcher of claim 6, further comprising a handle member for supporting said plunger sleeve, further comprising means for pivotally joining said plunger sleeve with said reservoir housing such that said plunger sleeve and said reservoir housing are pivotable with respect to one another.

10. The launcher of claim 3, further comprising tubular handle means attached to said plunger coaxial with said plunger and said plunger sleeve.

11. The launcher of claim 10, said tubular handle means having an auxiliary handle member extending generally outwardly from an axis thereof.

12. The launcher of claim 3, wherein said piston sleeve is pivotable with respect to a direction in which said mounting means is aimed such that said pumping mechanism may be operated without being aligned with a direction in which the projectile will be launched.

13. The launcher of claim 3, further comprising a handle member for supporting said plunger sleeve.

14. A launcher for a projectile comprising:

a pumping mechanism having a plunger having a shaft terminating in a plunger piston at a first end thereof said shaft defining a first bore for receiving the fluid extending therethrough to said plunger piston, a second bore defined by said plunger piston extending therethrough in alignment with said first bore and a check valve positioned upon said plunger piston over said second bore, having a plunger sleeve closed at one end thereof closely receiving said plunger piston, and defining a first aperture through a wall of said plunger sleeve proximate said closed end of said plunger sleeve;

a piston member having an anterior head and a posterior head each of compressible material;

a piston sleeve receiving said piston member in reciprocal translatable relation therein, defining an anterior nozzle facing said anterior head of said piston member, defining a posterior nozzle facing said posterior head of said piston member, and having a wall defining at least one second aperture therethrough proximate said anterior nozzle;

a reservoir housing forming a chamber for receiving and storing the fluid generally encasing said piston sleeve such that an anterior end of said piston sleeve corresponding to said anterior nozzle is within said reservoir housing adjacent a wall of said reservoir housing and defining a third aperture through said wall of said reservoir housing in alignment with said opening at said anterior end of said piston sleeve;

a conduit forming a passageway for the fluid between said first aperture and said posterior nozzle of said piston sleeve; and a plurality of open-ended tubes for receiving the projectile each defining a third bore therethrough affixed to a base rotatably attached to said reservoir housing such that one of said plurality of tubes may selectively be aligned with said third aperture through said wall of said reservoir housing.

15. The launcher of claim 14, further comprising a support housing for supporting said plunger sleeve and wherein said support housing and said reservoir housing are joined to one another generally forming a central housing.

16. The launcher of claim 14, further comprising tubular handle means attached to said plunger coaxial with said plunger and said plunger sleeve such that an opening into said first bore through which the fluid is received is unobstructed.

17. The launcher of claim 16, said tubular handle means having an auxiliary handle member extending generally outwardly from an axis thereof.

18. The launcher of claim 14, further comprising means pivotally attaching said plunger sleeve and said reservoir housing to one another such that said pumping mechanism may be operated without being aligned with a direction in which the toy projectile will be launched.

19. A launcher for a projectile comprising:

a pumping mechanism having a plunger having a shaft terminating in a plunger piston at a first end thereof said shaft defining a first bore for receiving the fluid extending therethrough to said plunger piston, a second bore defined by said plunger piston extending therethrough in alignment with said first bore and a check valve positioned upon said plunger piston over said second bore, having a plunger sleeve closed at one end thereof closely receiving said plunger piston, and defining a first aperture through a wall of said plunger sleeve proximate said closed end of said plunger sleeve;

a piston member having an anterior head and a posterior head each of compressible material;

a piston sleeve generally encased within said reservoir housing receiving said piston member in reciprocal translatable relation therein, defining an anterior nozzle facing said anterior head of said piston member, defining a posterior nozzle facing said posterior head of said piston member, and having a wall defining at least one second aperture therethrough proximate said anterior nozzle;

a reservoir housing forming a chamber for receiving and storing the fluid generally encasing said piston sleeve such that an anterior end of said piston sleeve corresponding to said anterior nozzle is within said reservoir housing adjacent a wall of said reservoir housing and defining a third aperture through said wall of said reservoir housing in alignment with said opening at said anterior end of said piston sleeve;

means pivotally attaching said plunger sleeve and said reservoir housing to one another such that said pumping mechanism may be operated without being aligned with said direction in which the projectile will be launched;

a conduit forming a passageway for the fluid between said first aperture and said posterior nozzle of said piston sleeve; and mounting means for receiving the projectile defining a third bore therethrough attached to said reservoir housing such that said third bore is aligned with said third aperture through said wall of said reservoir housing.

20. The launcher of claim 19, further comprising tubular handle means attached to said plunger coaxial with said plunger and said plunger sleeve such that an opening into said first bore through which the fluid is received is unobstructed and a handle member for supporting said plunger sleeve.

* * * * *